US005231392A

United States Patent [19]

Gust

[11] Patent Number: 5,231,392

[45] Date of Patent: Jul. 27, 1993

[54] PORTABLE VEHICLE PARKING ASSISTANCE DEVICE

[76] Inventor: Walter S. Gust, Rte. 5, Box 55, Washington, N.C. 27889

[21] Appl. No.: 804,912

[22] Filed: Dec. 11, 1991

[51] Int. Cl.[5] ..... B60Q 1/48

[52] U.S. Cl. ..... 340/932.2; 200/61.41; 116/28 R

[58] Field of Search ..... 340/932.2, 436, 437, 340/908.1, 693; 116/28 R; 180/274; 200/61.41

[56] References Cited

U.S. PATENT DOCUMENTS

| | | | |
|---|---|---|---|
| 2,296,311 | 9/1942 | Schneider | 116/28 |
| 2,454,896 | 11/1948 | Traub | 340/932.2 |
| 2,956,262 | 10/1960 | Bahr | 200/61.41 X |
| 3,668,626 | 6/1972 | Follett | 200/61.41 X |
| 3,820,065 | 6/1974 | Koplewicz et al. | 340/932.2 |
| 3,922,638 | 11/1975 | Mendelsohn | 340/932.2 |
| 4,145,681 | 3/1979 | Bubnich et al. | 340/932.2 |
| 4,311,983 | 1/1982 | Piper | 340/932.2 |
| 4,318,077 | 3/1982 | Bubnich et al. | 340/932.2 |
| 4,341,488 | 7/1982 | Ryan | 340/932.2 |
| 4,859,983 | 8/1989 | Kulp | 340/908.1 |
| 4,870,413 | 9/1989 | Walden et al. | 340/932.2 |
| 4,873,509 | 10/1989 | Simi | 340/436 |
| 4,901,071 | 2/1990 | Fletcher | 340/932.2 |
| 4,965,571 | 10/1990 | Jones | 340/932.2 |
| 4,977,400 | 12/1990 | Jeffries | 340/932.2 |

*Primary Examiner*—Jin F. Ng
*Assistant Examiner*—Christine K. Oda
*Attorney, Agent, or Firm*—Dalton L. Truluck

[57] ABSTRACT

A portable vehicle parking assistance device that can be used in any parking location to indicate when a vehicle has reached a selected point and should be stopped. The device includes a movable sensor arm extending upwardly from a tray which contains ballast material that provides sufficient weight to maintain the entire parking assistance device in the desired position on a garage floor or other surface on which the vehicle travels. The upper end of the movable sensor arm carries a motion indicator located in the sight of the vehicle driver to signal the driver when the bumper or other extremity of the vehicle has contacted the sensor arm and should be stopped. Preferably, both an audible indicator and a signal light are provided in addition to the motion indicator to signify that the vehicle should be stopped immediately.

23 Claims, 2 Drawing Sheets

FIG. 1
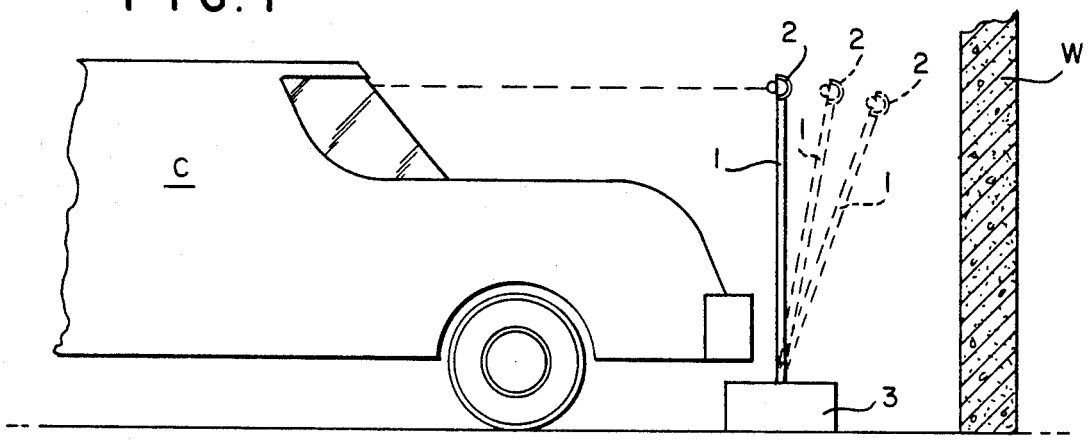
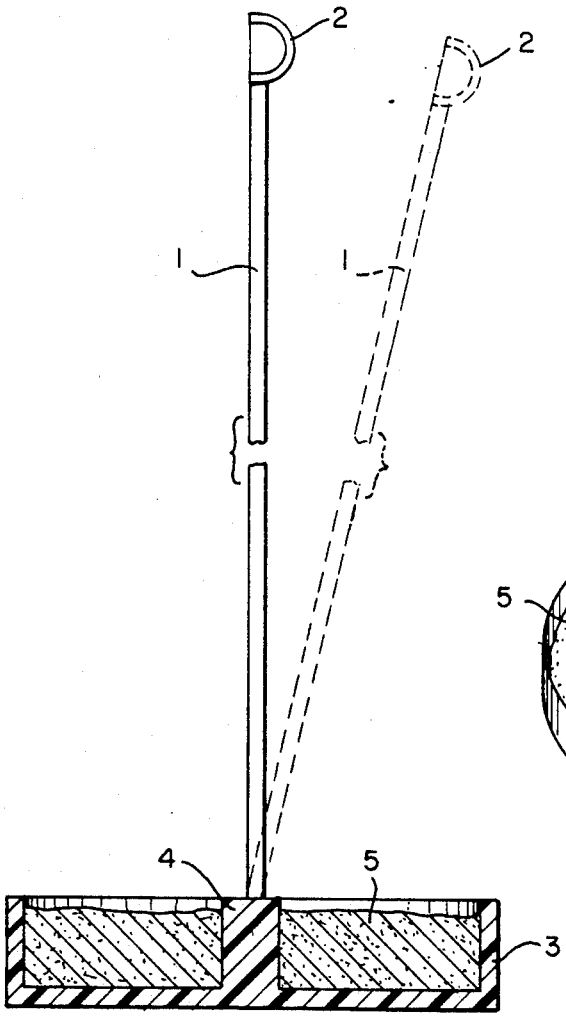
FIG. 2
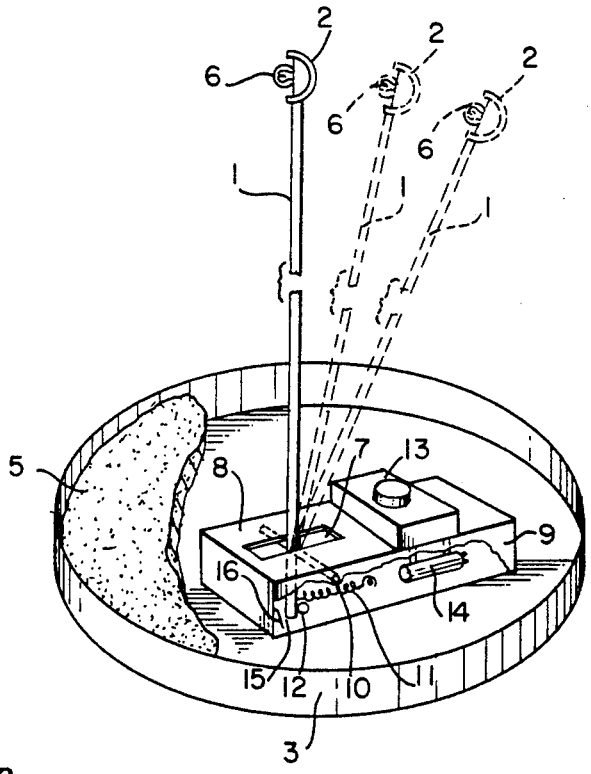
FIG. 3

PORTABLE VEHICLE PARKING ASSISTANCE DEVICE

BACKGROUND OF THE INVENTION

1. Field of the Invention

The present invention relates to a vehicle parking aid and signaling device which assists in parking a vehicle in a desired position within a confined parking area, e.g. a garage. More particularly, the invention is directed to a simple, completely self-contained, portable vehicle parking assistance device that can be used in any parking location to indicate when a vehicle has reached a selected point and should be stopped.

2. Description of the Prior Art

The use of vehicle parking assistance devices is well known in the prior art, and a great number of contrivances have been developed for this purpose. However, all of the known devices of this character have drawbacks which make them impractical and/or of limited application. For instance, some of the prior art devices require a large number of parts and thus are expensive to manufacture as well as difficult to assemble, install and maintain. Others must be mounted to a fixed structure, such as a wall, and thus lack portability and are incapable of easy movement to different locations. Still others fail to give a foolproof indication of vehicle position and, hence, lack effectiveness.

Attention is directed to the following United States patents as examples of parking assistance devices analogous to the subject matter of the instant invention:

| | | |
|---|---|---|
| 2,296,311 | Sept. 22, 1942 | Schneider |
| 2,956,262 | Oct. 11, 1960 | Bahr |
| 3,668,626 | June 6, 1972 | Follett |
| 3,820,065 | June 25, 1974 | Koplewicz et al. |
| 3,922,638 | Nov. 25, 1975 | Mendelsohn |
| 4,145,681 | March 20, 1979 | Bubnich et al. |
| 4,873,509 | Oct. 10, 1989 | Simi |
| 4,965,571 | Oct. 23, 1990 | Jones |

The most pertinent of those patents listed above are believed to be the Mendelsohn and Simi patents, and of these, Mendelsohn is seen to be the most closely related. Similarly to the present invention, Mendelsohn's device employs a large container or tray surrounding the functional components of the indicator assembly of his parking assistance device for containing a ballast. However, unlike the present invention, the ballast utilized by Mendelsohn is concrete which must be mixed separately by the user and poured into the tray where it hardens and thereafter becomes a permanent part of the structure, thereby greatly increasing the weight of the entire device and thus severely limiting the ability to transport the device to different locations when desired. In addition, the Mendelsohn device involves a switch and mechanical construction that includes numerous parts and requires a specialized compartment to house the several switch parts. Also, the light bulb employed as a visual indicator in Mendelsohn is mounted at a remote position from the other components of the device. As a result, the Mendelsohn device is not a self-contained construction that is totally portable as a single unit. Furthermore, in order to utilize the Mendelsohn device with a vehicle having a bumper at a relatively great distance above the surface upon which the vehicle travels, it is necessary to elevate the ballast tray above such surface by means of separately attached legs. Such makes the device top heavy and susceptible to tipping over when engaged by the vehicle, thus rendering it inoperative.

The device disclosed in the Simi patent likewise fails to possess many of the features of the present invention. For example, in Simi there is no indicator in the view of the driver of the vehicle and only a single power-dependent audio signal is used to alert the driver of the position of the vehicle. If the audio signal fails, the driver will not be alerted to stop the vehicle.

It is clear from the Mendelsohn and Simi patents just discussed, as well as the other patents listed above, that prior vehicle parking assistance devices either have been complex mechanically and/or electrically, or have required mounting on a fixed structure, such as a wall, all of which makes them impractical for the changing parking position requirements commonly encountered in home garage situations or other parking locations. Also, many such devices provide only a single power-source-dependent mode of warning a driver of the position of a vehicle and, hence, are totally ineffective when that mode fails to function.

SUMMARY OF THE INVENTION

It is the objective and purpose of the present invention to provide a vehicle parking assistance device which is simple in construction, employs a minimum of parts, is completely portable, offers several independent signals or alarms to alert a driver that a predetermined position of the vehicle has been reached, is easy to install and maintain, and eliminates the drawbacks of the prior art devices.

The vehicle parking assistance device of this invention can be utilized wherever it is important to stop movement of a vehicle before it comes into contact with a stationary structure such as the wall of a garage, a pillar in a parking area, an object within a garage or carport, or any item or point within the path of the vehicle. Alternatively, the device may be used to provide an indication that a vehicle has advanced sufficiently within a garage to permit closing of the garage door without interfering with the rear of the vehicle.

In accordance with the invention, the portable vehicle parking assistance device includes a sensor arm having at its top end a reflector or other visual indicating means such as a flag, ball, emblem, or the like which is located in the sight of the vehicle driver and serves as a motion indicator to signal the driver when the bumper or other extremity of the vehicle has contacted the sensor arm and the vehicle should be stopped. The bottom or lower end of the sensor arm is attached to a base structure which in turn is affixed to or forms a unitary part of a tray that rests upon the floor of a garage or other surface on which the vehicle travels. The tray serves as a container for receiving a ballast material such as sand, dirt, gravel or the like which provides sufficient weight to maintain the entire parking assistance device in the desired position on the garage floor or other parking surface.

In the preferred versions of the invention, both an audible and an illumination signal means are provided in addition to the motion indicator to signify that the vehicle should be stopped immediately. The audible signal means may be a buzzer, bell, horn or other sound-emitting device, and the illumination signal means may be an ordinary flashlight bulb or other low-voltage bulb. The audible and illumination signal means are connected in circuit with a conventional battery and with a switch which closes upon movement of the sensor arm. In one preferred version, the lower end of the sensor arm itself serves as one contact of the switch. In a second preferred version, the lower end of the sensor arm moves into engagement with the movable contact of a switch and closes the switch. In both the first and second preferred versions, all components of the power supply (battery) and switch are housed within a separate housing assembly which is fixed to the ballast tray in the vicinity of the center thereof.

In all embodiments of the invention, when a vehicle reaches a pre-selected point, the bumper or other extremity of the vehicle will contact the sensor arm and cause movement of the sensor arm motion indicator. When the driver sees the movement of the motion indicator, he knows that the vehicle is in proper position and should be stopped. In the versions employing an audible and illumination signal means, slight continued movement of the vehicle after initial engagement with the sensor arm causes the switch to close with consequent activation of the audible and illumination signal means, thereby alerting the driver to stop further vehicle movement immediately. The audible and illumination signal means remain on until slight reverse movement of the vehicle releases pressure on the sensor arm allowing it to return toward its normal position.

BRIEF DESCRIPTION OF THE DRAWINGS

The invention is illustrated by way of example in the accompanying figures in which:

FIG. 1 is a diagrammatic view illustrating the portable vehicle parking assistance device of the invention in position for signalling the approach of a vehicle toward a garage wall or similar obstruction;

FIG. 2 is an elevational view, partly in section, of the portable vehicle parking assistance device of the invention in its simplest version;

FIG. 3 is an elevational view, with parts broken away to show internal details, of a second version of the invention;

DETAILED DESCRIPTION OF THE INVENTION

Figure 4:
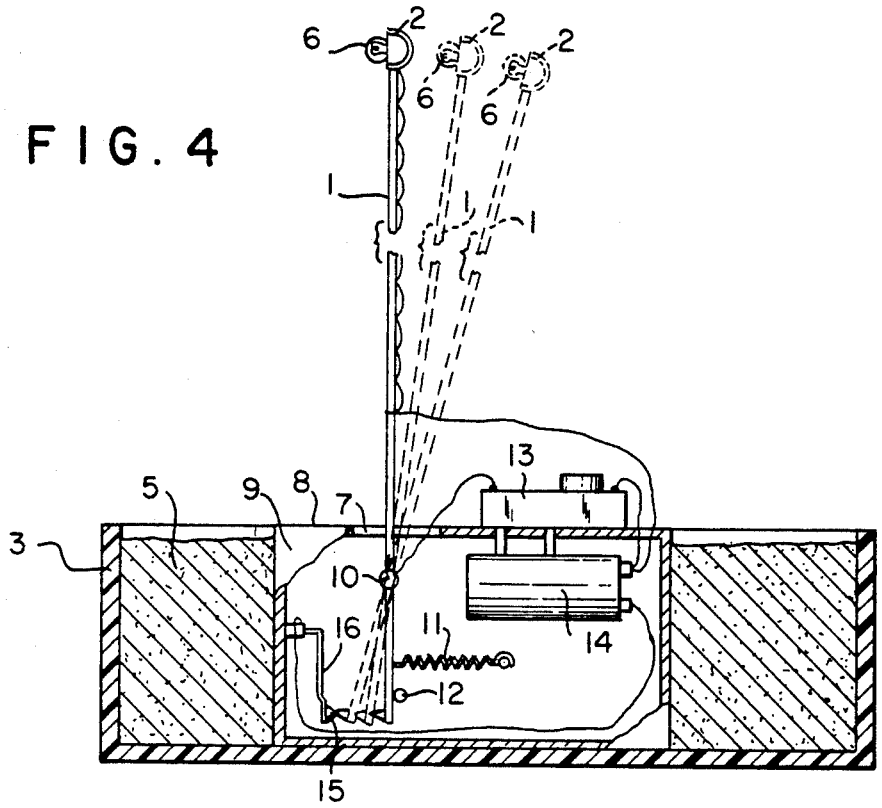
FIG. 4 is a side view, partially in section, illustrating in detail the individual components of the second version shown in FIG. 3.

Referring first to FIGS. 1 and 2, the invention can be seen in its simplest form. In this version the portable vehicle parking assistance device is composed of an elongated sensor arm 1, a motion indicator 2 at the upper end of the sensor arm 1, and a base in the form of a tray 3 for receiving suitable ballast 5 to provide sufficient weight to maintain the device in the desired position upon a garage floor or other parking surface. Secured substantially centrally to the tray 3 in its interior is a support pillar 4 which receives the lower end of the sensor arm 1 and anchors the sensor arm to the tray so that it extends upwardly therefrom in cantilever fashion. The sensor arm is a flexible, resilient rod of a length such that its upper end extends into the line of sight of the driver of the vehicle, as indicated by the dashed horizontal line in FIG. 1. The sensor arm may be composed of jointed sections, but preferably is telescopic so that it can be adjusted readily to the heights of different vehicles. The motion indicator 2 is illustrated as being a reflector of the sort commonly used in conjunction with a flashlight bulb or the like but may instead be a flat or curved piece of light-reflective material or any other suitable visual indicating means such as a flag, ball, emblem or the like. The ballast tray 3 is constructed of thin light weight material, preferably plastic, with an open outer rim for confining ballast material such as sand, dirt, gravel, etc. The tray can have any shape but typically would be round, oval, or rectangular.

The operation of the version just described is best understood with reference to FIG. 1 wherein a vehicle, in this instance a car C, is shown approaching the parking assistance device which has been previously properly positioned in front of wall W. When the car bumper contacts the sensor arm 1, movement of the motion indicator (reflector) 2, which has been adjusted to be viewed from the vehicle driver seat, will be observed by the driver. This indicates that the vehicle has reached a pre-selected point and should be stopped immediately. When the vehicle is backed away from the sensor arm, the sensor arm will flex back to its original position in readiness for operation again.

Turning now to FIGS. 3 and 4, wherein the second version of the invention is depicted, it can be seen that this version, like the first, also includes a sensor arm 1 extending upwardly from the center of a tray 3 for receiving ballast 5. The sensor arm 1 again has a suitable motion indicator such as reflector 2 attached to its upper end. However, in this version the sensor arm 1 is semi-rigid. The term "semi-rigid" in this context means stiff but possessing resiliency, i.e., "memory". Also in this version the upper end of the sensor arm additionally carries an illumination signal means such as an ordinary flashlight bulb or other low-voltage bulb 6 mounted within the reflector 2. Further, the lower end of the sensor arm 1 extends through a slot 7 in the cover 8 of a housing or case 9 and is attached to a pivot pin 10 about which the entire sensor arm 1 pivots when contacted by the bumper or other extremity of a vehicle. The semi-rigid sensor arm in this version is maintained in its normal or upright position by a sensor arm biasing means such as return spring 11 which urges the lowermost portion of sensor arm 1 against a stop 12.

In the illustration shown in the drawing, the cover 8 of the case 9 carries on its top an audible signal means such as a buzzer, bell, horn or other conventional sound-emitting device 13. Alternatively, however, the audible signal means 13 could be mounted on the sensor arm 1 at a location below the illumination signal means. The interior of the case houses a suitable power supply such as battery 14, a switch 15, and the necessary wires to connect the bulb 6, buzzer 13, battery 14, and switch 15 in operative circuit arrangement.

The electrical connections or circuitry provided for connecting the audible signal means 13 and illumination signal means 6 are shown in FIG. 4. In this version, the semi-rigid sensor arm 1 is made of electrically conductive material and itself serves as the movable contact of switch 15 and as the conductor extending therefrom to one terminal of the illumination signal means bulb 6. The other terminal of bulb 6 is connected by a wire to one terminal of battery 14, and the other terminal of battery 14 is connected by a wire to the fixed contact, designated 16, of switch 15. The audible signal means 13 is connected in parallel with bulb 6.

The wire extending from bulb 6 to the battery 14 may be clipped, taped or otherwise secured to the sensor arm 1 on the side thereof opposite to that which will be contacted by a vehicle. Preferably, however, the sensor arm 1 is made tubular and the wire runs through the sensor arm. Of course, sufficient wire length must be provided to enable the adjustment of the sensor arm to accommodate vehicles of different heights.

In use, the version of the invention illustrated in FIGS. 3 and 4 provides three independent signals to a vehicle driver. When a vehicle body part contacts the adjustable length sensor arm 1 with its top-mounted motion indicator 2 and signal illumination means 6, the sensor arm will pivot about pivot pin 10 and this movement will be observed by the driver who will see the motion indicator 2 move. This initial visual indication alerts the driver that the vehicle has reached a preselected point and should be stopped. Further movement of the vehicle in the same direction will place more pressure on the sensor arm causing it to move slightly more to close switch 15 and thereby activate the illumination signal means (bulb) 6 at the top and the audible signal means (buzzer) 13, thus indicating to the driver that the vehicle should be stopped immediately. The audible and illumination signals remain on until the vehicle is moved in the opposite direction sufficiently to release pressure on the sensor arm and permit switch 15 to open. The initial visual indication of vehicle location, i.e., the indication given by motion indicator 2, is purely mechanical and will continue to function as a fail-safe in the event of malfunction of any of the electrical components of the device or in the event of power supply failure. No other known device provides this combination of alarms or safety features.

Figure 5:
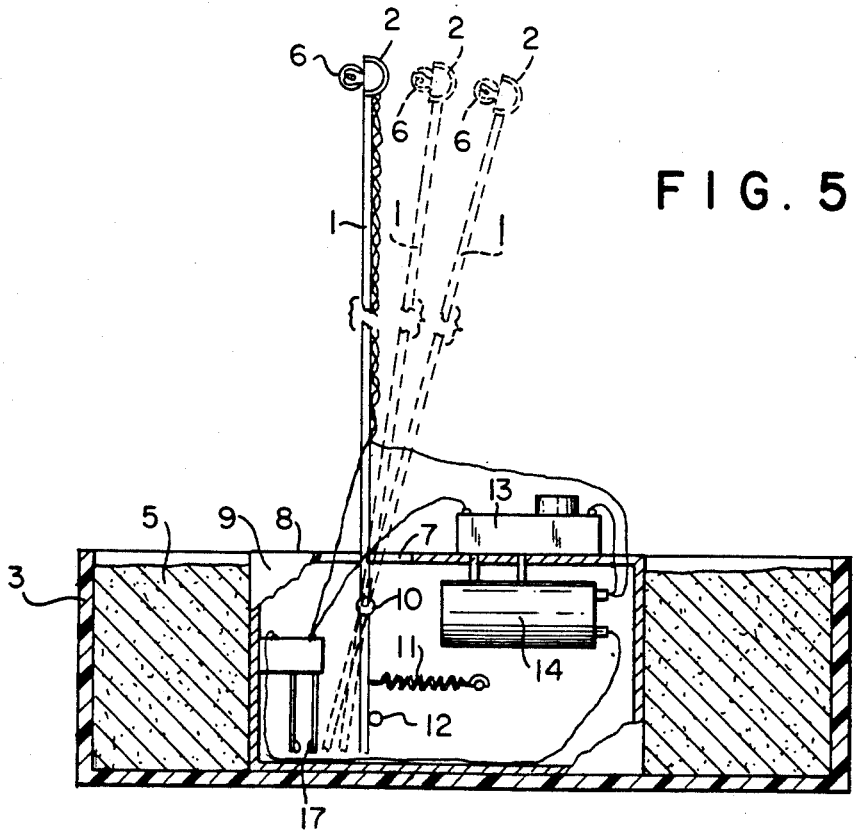
FIG. 5 is a view similar to that of FIG. 4 but illustrating a third version of the invention.

The final version, depicted in FIG. 5, differs from the version shown in FIGS. 3 and 4 in only one respect. Specifically, rather than the pivoted sensor arm 1 functioning as one contact of the switch, the version of FIG. 5 employs a separate switch 17 which is closed by the lowermost portion of sensor arm 1 pushing the movable contact of the switch into engagement with the fixed contact of the switch. In this version it is not essential that the sensor arm be made of electrically conductive material because it is not utilized to form an electrical connection between the bulb 6 and switch 17. Rather, a separate wire is employed.

In all versions of the invention, the portable vehicle parking assistance device can be used indoors or outdoors, can be employed to indicate forward or reverse movement, and can be utilized to inform the driver when the side of a vehicle has reached a particular position, such as when a door is at a certain point. Also in all versions, the sensor arm is vertically adjustable to accommodate different vehicle heights, e.g., cars of different sizes, trucks, tractors, airplanes, etc. In the versions shown in FIGS. 3–5, sensitivity can be adjusted somewhat by changing the tension of spring 11.

It should be understood that the several depicted versions of the invention are not limited to the precise constructions and configurations illustrated in the drawing figures. For example, in the FIG. 2 version, the support pillar 4 need not be unitary or in one piece with the bottom of the tray 3 but instead may be a separate part affixed to the tray. Similarly, in the versions of FIGS. 3–5, the battery 14 need not be attached to the underside of the cover 8, as shown, but may be positioned at any convenient location within case 9. Likewise, in the versions of FIGS. 3–5, the audible signal means 13 may be attached to case 9 at locations other than on cover 8, and may even be placed within case 9 or, if desired, on the sensor arm below the illumination signal means. Further, obviously the spring 11 of the versions of FIGS. 3–5 could be replaced by a suitable elastic device. Of course, a suitable alternating current to direct current power supply could be substituted for the battery in the versions shown in FIGS. 3–5.

From the foregoing description, it is apparent that the vehicle parking assistance device of the invention is very readily and easily transported, completely portable, and of low cost. Further, its simplicity of construction makes it virtually foolproof and immune to total failure. Thus it is seen that the objects of the invention set forth above have been achieved.

I claim:

1. A portable vehicle parking assistance device for resting upon a surface upon which a vehicle travels, comprising: a tray for positioning on said surface, said tray having an open top for receiving ballast material to maintain the tray in a set position on said surface, a sensor arm consisting of a flexible, resilient rod having a lower end firmly anchored to said tray so as to be immovable with respect to said tray, and having an upper end extending upwardly from the tray in cantilever fashion so as to be movable relative to said tray, said flexible, resilient rod having a length such that the top of said upper end is positioned at a height above said tray so that said top is visible to a driver of said vehicle when an extremity of said vehicle comes into contact with said flexible, resilient rod, and a motion indicator affixed to said top of said upper end of said flexible, resilient rod for alerting the driver of said vehicle that said extremity of said vehicle has contacted said flexible, resilient rod.

2. The device of claim 1 wherein the flexible, resilient rod has sections for enabling the flexible, resilient rod to be adjusted to different heights.

3. The device of claim 1 wherein the motion indicator is a reflector.

4. A portable vehicle parking assistance device for resting upon a surface upon which a vehicle travels, comprising: a tray for positioning on said surface, said tray having an open top for receiving ballast material to maintain the tray in a set position on said surface, a case located within said tray and affixed to the interior of said tray, a semi-rigid sensor arm having an upper end and a lower end, said semi-rigid sensor arm being pivotally attached to said case near said lower end and having said upper end extending vertically from said case to a height above said tray whereat said upper end is visible to a driver of said vehicle when an extremity of said vehicle comes into contact with the semi-rigid sensor arm, a motion indicator and an illumination signal element carried by said semi-rigid sensor arm near the top of said upper end, an electrical switch within said case, said switch having a fixed contact and a movable contact, said movable contact being movable to engage the fixed contact when said semi-rigid sensor arm pivots in response to said extremity of said vehicle coming into contact with the semi-rigid sensor arm, said lower end of said semi-rigid sensor arm being positioned adjacent to said movable contact and being movable into direct engagement with said movable contact to cause the movable contact to move to engage the fixed contact, and a power supply operatively connected in circuit with said switch and with said illumination signal element such that said illumination signal element is actuated upon closing of said switch.

5. The device of claim 4 further including means for biasing said lower end of said semi-rigid sensor arm out of direct engagement with said movable contact until the semi-rigid sensor arm is pivoted.

6. The device of claim 5 further including a stop to limit movement of the lower end of the semi-rigid sensor arm in a direction away from the movable contact of the switch.

7. The device of claim 4 further including an audible signal element connected electrically in parallel with said illumination signal element.

8. The device of claim 7 wherein the audible signal element is a buzzer.

9. The device of claim 7 wherein the case has a cover and the audible signal element is mounted on the exterior of the cover.

10. The device of claim 4 wherein the motion indicator is a reflector.

11. The device of claim 4 wherein the power supply is a battery located within the case.

12. The device of claim 4 wherein the semi-rigid sensor arm has sections for enabling said semi-rigid sensor arm to be adjusted to different heights.

13. A portable vehicle parking assistance device for resting upon a surface upon which a vehicle travels, comprising: a tray for positioning on said surface, said tray having an open top for receiving ballast material to maintain the tray in a set position on said surface, a case located within said tray and affixed to the interior of said tray, a semi-rigid sensor arm formed of electrically conductive material and having an upper end and a lower end, said semi-rigid sensor arm being pivotally attached to said case near said lower end and having said upper end extending vertically from said case to a height above said tray whereat said upper end is visible to a driver of said vehicle when an extremity of said vehicle comes into contact with the semi-rigid sensor arm, a motion indicator and an illumination signal element carried by said semi-rigid sensor arm near the top of said upper end, an electrical switch within said case, said switch having a fixed contact and a movable contact, said fixed contact comprising an electrically conductive member attached to the interior of said case, said movable contact being the lower end of said electrically conductive semi-rigid sensor arm, means for biasing said movable contact away from said fixed contact so as to maintain the switch normally in an open position, said movable contact being movable into engagement with said fixed contact when said semi-rigid sensor arm is contacted by said extremity of said vehicle to cause pivoting of said semi-rigid sensor arm, and a power supply operatively connected in circuit with said illumination signal element, with said movable contact constituted by the lower end of said electrically conductive semi-rigid sensor arm, and with said fixed contact such that said illumination signal element is actuated upon closing of said switch.

14. The device of claim 13 further including an audible signal element connected electrically in parallel with said illumination signal element.

15. The device of claim 14 wherein the audible signal element is a buzzer.

16. The device of claim 14 wherein the case has a cover and the audible signal element is mounted on the exterior of the cover.

17. The device of claim 13 wherein the motion indicator is a reflector.

18. The device of claim 13 wherein the power supply is a battery located within the case.

19. The device of claim 13 wherein the means for biasing is a spring.

20. The device of claim 13 wherein the case has a cover with an elongated slot and the lower end of the semi-rigid sensor arm extends through said elongated slot.

21. The device of claim 13 wherein the semi-rigid sensor arm has sections for enabling said semi-rigid sensor arm to be adjusted to different heights.

22. The device of claim 13 wherein the motion indicator is a reflector and the illumination signal element is a light bulb mounted within the reflector.

23. The device of claim 13 further including a stop to limit movement of the lower end of the semi-rigid sensor arm in a direction away from the fixed contact.

* * * * *